US005604063A

United States Patent [19]

Endo et al.

[11] Patent Number: 5,604,063

[45] Date of Patent: Feb. 18, 1997

[54] COMPOSITION FOR CHARGE TRANSPORT LAYER AND ELECTROPHOTOGRAPHIC MEMBER USING SAME

[75] Inventors: Keiichi Endo; Seiji Miyaoka; Kouji Ohkoshi; Susumu Kaneko; Yasuo Katsuya; Akira Kageyama, all of Hitachi; Yoshii Morishita, Tochigi-ken, all of Japan

[73] Assignee: Hitachi Chemical Company, Ltd., Tokyo, Japan

[21] Appl. No.: 977,182

[22] Filed: Nov. 16, 1992

[30] Foreign Application Priority Data

Nov. 14, 1991 [JP] Japan ..... 3-297540
Jul. 6, 1992 [JP] Japan ..... 4-178194

[51] Int. Cl.[6] ..... G03G 15/02

[52] U.S. Cl. ..... 430/59; 430/96; 430/905; 528/202; 528/204

[58] Field of Search ..... 430/56, 57, 58, 430/59, 96, 905; 528/204, 202

[56] References Cited

U.S. PATENT DOCUMENTS

| | | | |
|---|---|---|---|
| 3,265,496 | 8/1966 | Fox | 430/73 |
| 3,615,415 | 10/1971 | Gramza | 430/76 |
| 4,882,253 | 11/1989 | Kato et al. | 430/59 |
| 4,971,874 | 11/1990 | Ueda | 430/58 |
| 4,988,571 | 1/1991 | Ueda . | |
| 5,213,924 | 5/1993 | Sakamoto | 430/58 |

FOREIGN PATENT DOCUMENTS

| | | | |
|---|---|---|---|
| 093914 | 11/1983 | European Pat. Off. | 528/204 |
| 0486038 | 5/1992 | European Pat. Off. . | |
| 61-264020 | 11/1986 | Japan | 528/204 |
| 62-227927 | 10/1987 | Japan | 528/204 |
| 63-136051 | 6/1988 | Japan | 430/96 |
| 4027584 | 12/1991 | Japan | 430/96 |
| 4179961 | 6/1992 | Japan | 430/96 |

OTHER PUBLICATIONS

English translation of JP 63–136051 (1988).

*Primary Examiner*—Mark Chapman
*Attorney, Agent, or Firm*—Antonelli, Terry, Stout & Kraus, LLP

[57] ABSTRACT

An electrophotographic member which can give printed images of high quality and is markedly high in photoresponsiveness can be provided without using halogen solvents by using a composition for charge transport layer which contains a polycarbonate resin having a recurring structural unit represented by the following formula (I) and, if necessary, a specific styryl compound, a specific hydrazone compound and the like:

(I)

wherein $R_1$ and $R_2$=alkyl, etc.

$R_3$ through $R_{18}$=H, alkyl, etc.

k/m=1/1–10/1.

8 Claims, 3 Drawing Sheets

COMPOSITION FOR CHARGE TRANSPORT LAYER AND ELECTROPHOTOGRAPHIC MEMBER USING SAME

BACKGROUND OF THE INVENTION

The present invention relates to a composition for charge transport layer and an electrophotographic member prepared using the composition.

Since electrophotographic members using organic photoconductive compounds are advantageous in flexibility, light weight, surface smoothness and price, recently they are widely studied. Among them, function separation type electrophotographic members having a charge generation layer wherein a charge carrier is formed by absorbing light and a charge transport layer wherein the charge carrier formed is transported by an electric field can remarkably improve photoresponsiveness and sensitivity which have been inferior in conventional electrophotographic members in which organic photoconductive compounds are used. Thus, the function separation type electrophotographic members have recently showed rapid progress. These function separation type electrophotographic members are mounted on electrophotographic devices (printers, copying machines, etc.) to which the Carlson method is applied.

However, with recent demand for enhancement in quality of printed images obtained by electrophotographic devices such as copying machines and laser beam printers and increase in printing speed owing to miniaturization of electrophotographic devices, electrophotographic members are further strongly required to give printed images of high quality and have rapid photoresponsiveness.

Hitherto, as binder resins for the charge transport layer of electrophotographic members, bisphenol A type polycarbonate resins represented by the following formula have been most commonly used from the points of transparency and mechanical strength.

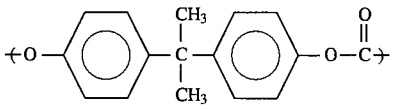

Compositions for charge transport layer are prepared by homogeneously dissolving or dispersing in a solvent a charge transporting substance, a bisphenol A type polycarbonate resin as a binder resin and if necessary, additives such as plasticizers, flowability imparting agents and pin hole inhibitors.

However, as can be seen from the above formula, since bisphenol A type polycarbonate resins are inferior in solubility, halogen solvents such as methylene chloride, 1,2-dichloromethane and 1,1,2-trichloroethane are used each alone or in admixture or mixed solvents of halogen solvents and non-halogen solvents are used.

Furthermore, for obtaining a high photoresponsiveness, it is necessary to increase the drift mobility. For this purpose, usually the amount of the charge transporting substance in the composition for charge transport layer is increased.

In the composition for charge transport layer in which content of the charge transporting substance is increased, when this is in the form of a solution, the charge transporting substance and bisphenol A type polycarbonate resin are uniformly dissolved, but when this is dried and the solvent is removed to form a solid charge transport layer, the charge transporting substance and the bisphenol A type polycarbonate resin separate from each other and the coat tends to become ununiform in both the form and the composition. When electrophotographic members are prepared using such composition, defects in images such as fogging, black points and white stains occur from the initial stage of use. Thus, electrophotographic members which satisfy the high photoresponsiveness and the high image quality have not yet been obtained. On the other hand, movement for the environmental protection of the earth has become active and abolition of the use of freon which destroys the ozone layer has been demanded and regulations for use of halogen solvents which contaminates underground water have been strengthened.

As polycarbonate resins soluble in non-halogen solvents, there have been known bisphenol Z type polycarbonate resins having the recurring unit represented by the following formula:

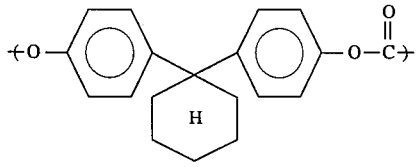

However, when these bisphenol Z type polycarbonate resins are used, there is a problem in that even when amount of the charge transporting substance in the charge transport layer is increased, the drift mobility cannot be increased, and when the charge transporting substance is contained in a large amount for obtaining high photoresponsiveness, there occurs a problem in that the film strength of the charge transport layer decreases.

SUMMARY OF THE INVENTION

An object of the present invention is to solve the problems of the conventional techniques, namely, to provide a composition for charge transport layer which requires no halogen solvents and can give printed images of high quality and high resolution and have a high photoresponsiveness and furthermore, to provide an electrophotographic member prepared using the composition.

The above object has been attained by using a polycarbonate resin having a specific recurring unit and if necessary, a specific styryl compound and a specific hydrazone compound in the composition for charge transport layer.

That is, the present invention provides a composition for charge transport layers which is characterized by containing at least one polycarbonate resin having the recurring structural unit represented by the following formula:

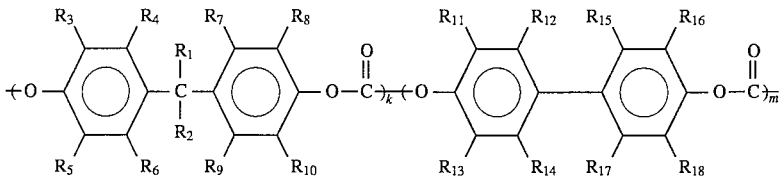

(I)

wherein $R_1$ and $R_2$ each represents a hydrogen atom, an alkyl group or an aryl group; $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, $R_{16}$, $R_{17}$ and $R_{18}$ each represents a hydrogen atom, a halogen atom, an alkyl group or an aryl group; and k and m each represents a positive integer and are selected so that k/m is in the range of 1–10, and an electrophotographic member, characterized by having a charge transport layer in which said composition is used.

The present invention further provides a composition for charge transport layers which comprises:

(a) a polycarbonate resin having the recurring structural unit represented by the formula (I):

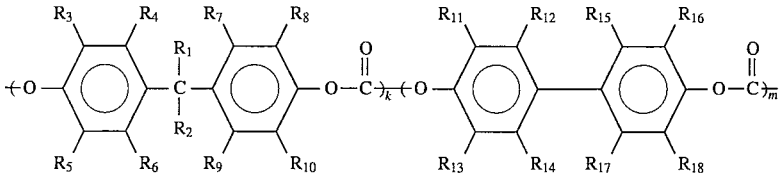

(I)

wherein $R_1$ and $R_2$ each represents a hydrogen atom, an alkyl group or an aryl group; $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, $R_{16}$, $R_{17}$ and $R_{18}$ each represents a hydrogen atom, a halogen atom, an alkyl group or an aryl group; and k and m each represents number of moles of the above recurring unit and are selected so that k/m is 1–10 (molar ratio), (b) a styryl compound represented by the formula (II):

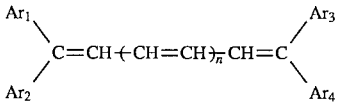

(II)

wherein $Ar_1$, $Ar_2$, $Ar_3$ and $Ar_4$ each represents a substituted or unsubstituted aryl group and n represents 0 or 1, (c) a hydrazone compound represented by the formula (III):

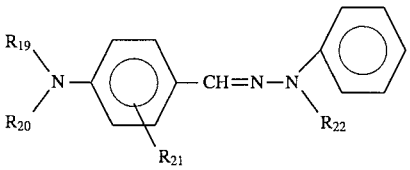

(III)

wherein $R_{19}$ and $R_{20}$ each represents an alkyl group, a phenyl group, a benzyl group or a methoxyphenyl group; $R_{21}$ represents a hydrogen atom, an alkyl group or O—R (R represents a straight or branched chain alkyl group of 5–10 carbon atoms or an aralkyl group of 7–10 carbon atoms); and $R_{22}$ represents an alkyl group, a phenyl group, a methoxy group, an ethoxy group, a benzyl group, a methoxyphenyl group, a tolyl group or a naphthyl group, and (d) a solvent, and an electrophotographic member having a charge transport layer formed using said composition.

The symbols k and m in the formula (I) represent the total mole number of the recurring unit containing $R_1$ and the total mole number of the recurring unit containing $R_{11}$, respectively. These recurring units may not necessarily be present in succession with these mole numbers and the polycarbonate resins having the recurring unit represented by the formula (I) may be random copolymers or block copolymers.

DESCRIPTION OF THE PREFERRED EMBODIMENTS

Figure 1:
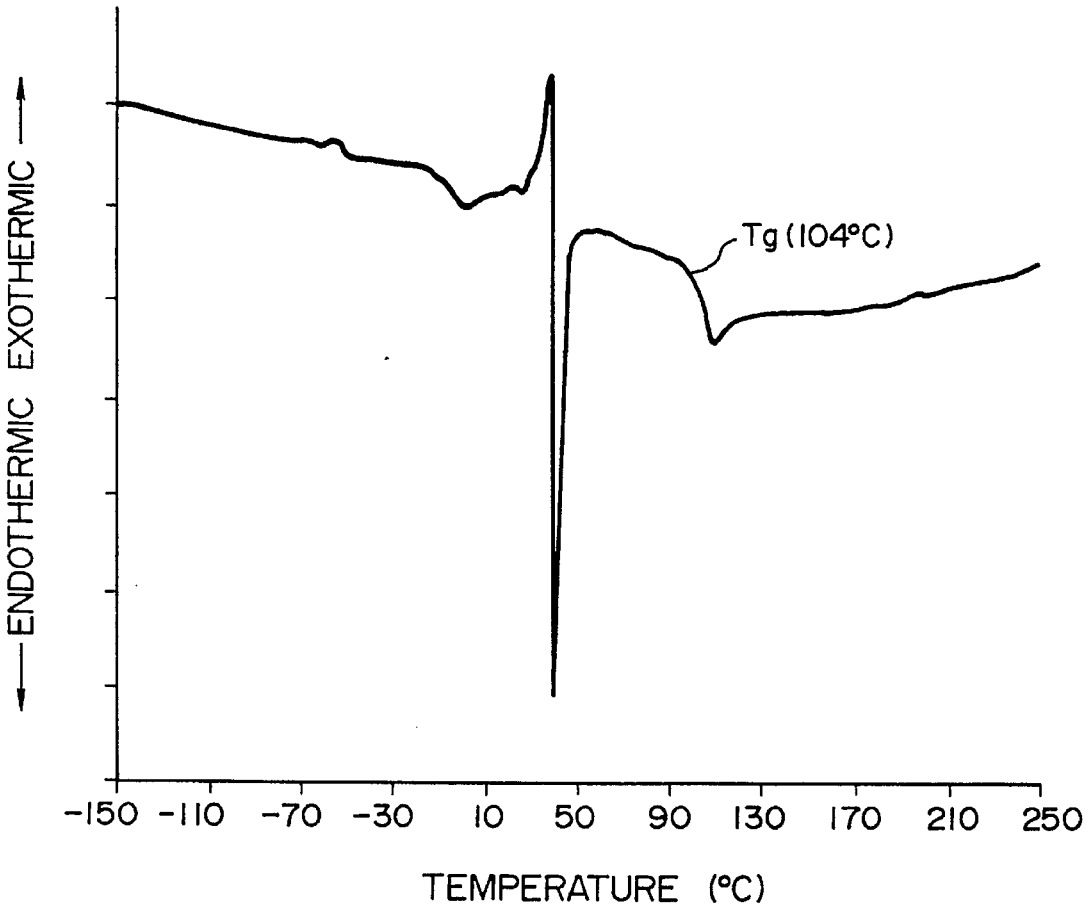
FIG. 1 is a DSC chart of the charge transport layer obtained in Example 1.

The present invention will be explained in detail.

The weight-average molecular weight Mw (in terms of polystyrene) of the polycarbonate resin having the recurring structural unit represented by the formula (I) is preferably 20,000–400,000 and more preferably 35,0001∝75,000 measured by gel permeation chromatography. When the molecular weight is less than 20,000, wear resistance of the charge transport layer tends to decrease and when it is more than 400,000, formation of the layer of uniform thickness tends to become difficult.

Among the definitions of the symbols in the formula (I), the halogen atom includes, for example, chlorine atom and fluorine atom and the alkyl group includes, for example, methyl, ethyl, n-propyl, isopropyl, n-butyl, tert-butyl, n-pentyl and n-hexyl. The aryl group includes, for example, phenyl, biphenyl, terphenyl and naphthyl.

The ratio of copolymer components k/m is selected to be in the range of 1–10, preferably in the range of 4–9. When the ratio k/m is less than 1 or more than 10, the resin becomes stiff and becomes difficult to dissolve in solvents.

The composition for charge transport layer of the present invention further contains a charge transporting substance. As the charge transporting substance, there may be used various compounds. Examples are shown below.

Styryl compounds represented by the following formula (II):

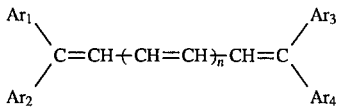

(II)

wherein $Ar_1$, $Ar_2$, $Ar_3$ and $Ar_4$ each represents a substituted or unsubstituted aryl group and n represents 0 or 1.

Hydrazone compounds represented by the following formula (IV):

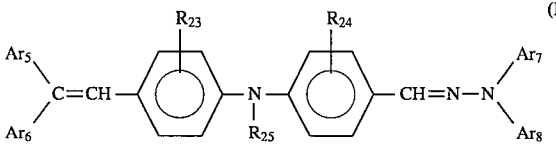

(IV)

wherein $R_{23}$ and $R_{24}$ each represents a hydrogen atom, an alkyl group, an alkoxy group or a halogen atom; $R_{23}$ represents a hydrogen atom, a substituted or unsubstituted alkyl group, a substituted or unsubstituted aralkyl group, a substituted or unsubstituted aryl group, a substituted or unsubstituted condensed polycyclic group or a substituted or unsubstituted heterocyclic group; $Ar_5$ and $Ar_6$ each represents a hydrogen atom, a substituted or unsubstituted alkyl group, a substituted or unsubstituted aryl group, a substituted or unsubstituted condensed polycyclic group or a substituted or unsubstituted heterocyclic group; $Ar_7$ and $Ar_8$ each represents a substituted or unsubstituted alkyl group, a substituted or unsubstituted aryl group, a substituted or unsubstituted condensed polycyclic group or a substituted or unsubstituted heterocyclic group, with a proviso that $Ar_5$ and $Ar_6$ cannot be simultaneously hydrogen atoms and $Ar_5$ and $Ar_6$ and/or $Ar_7$ and $Ar_8$ may form a ring or rings together.

Benzidine compounds represented by the following formula (V):

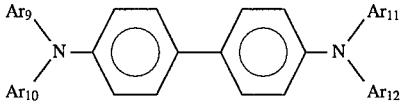

(V)

$Ar_9$, $Ar_{10}$, $Ar_{11}$ and $Ar_{12}$ each represents a substituted or unsubstituted aryl group.

As the substituents in the definitions of the symbols in the formulas (II)–(V), mention may be made of, for example, halogen atoms such as chlorine atom and fluorine atom; alkyl groups such as methyl, ethyl, n-propyl, isopropyl, n-butyl and tert-butyl; alkoxy groups such as methoxy, ethoxy, n-propoxy, isopropoxy and n-butoxy; aryl groups such as phenyl, biphenyl, terphenyl and naphthyl; fluoroalkyl groups such as trifluoromethyl, trifluoroethyl and pentafluoropropyl; and fluoroalkoxy groups such as trifluoromethoxy, 2,2-difluoroethoxy, 2,2,2-trifluoroethoxy, 1H,1H-heptafluorobutoxy, 2,2,3,4,4,4-hexafluorobutoxy and 4,4,4-trifluorobutoxy.

Preferred examples of the styryl compounds represented by the formula (II) are those which have the following structural formulas, but not limited thereto.

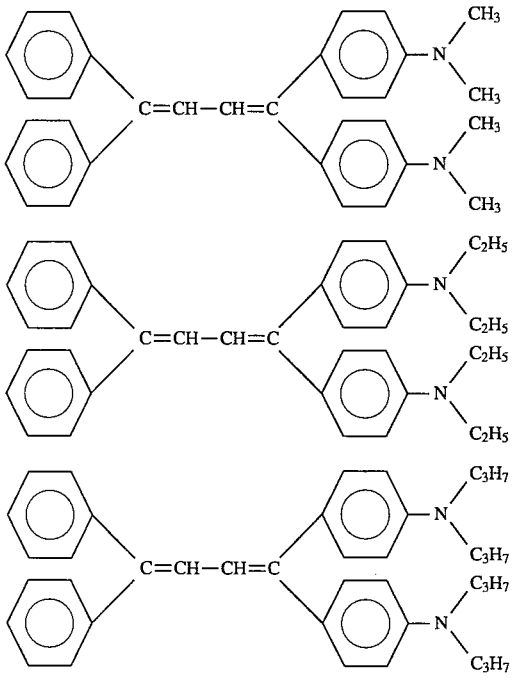

-continued

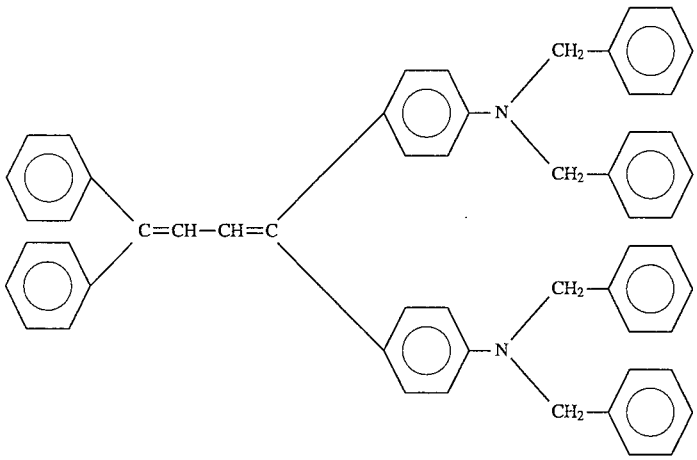

Preferred examples of the hydrazone compounds represented by the formula (IV) are those which have the following structural formulas, but not limited thereto.

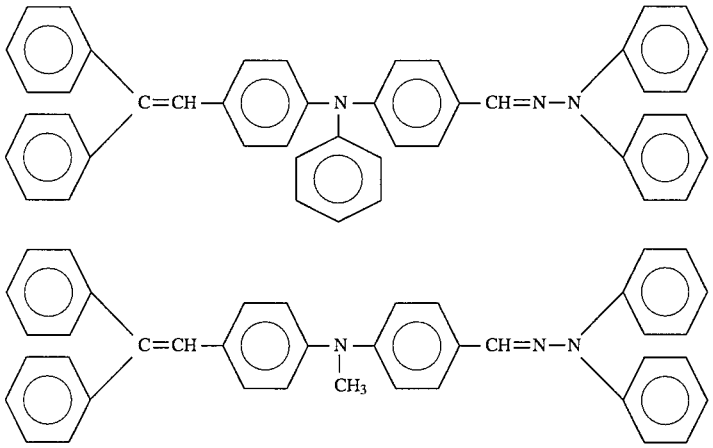

Preferred examples of the benzidine compounds represented by the formula (V) are those which have the following structural formulas, but not limited thereto.

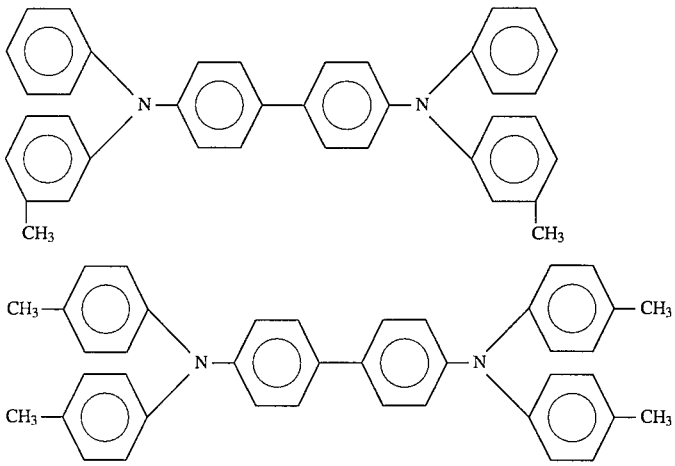

In the composition for charge transport layer of the present invention, non-halogen solvents are used as solvents. Use of the solvents of too high or too low boiling point causes unevenness in thickness of the coat and fluctuation in characteristics of the resulting electrophotographic members depending on the positions when dip coating is employed.

Therefore, solvents which have a boiling point of 35°–160° C. are preferred and those which have a boiling point of 40°–120° C. are more preferred.

Furthermore, in order to make the coat uniform in both the form and the composition, it is necessary that the solvents can dissolve the polycarbonate resins having the recurring structural unit represented by the formula (I) and the charge transporting substances such as the styryl compounds represented by the formula (II), the hydrazone compounds represented by the formulas (III) and (IV) and the benzidine compounds represented by the formula (V). Examples of these solvents are tetrahydrofuran, methyl ethyl ketone, benzene, toluene and xylene.

Amount of the solvents is preferably 300–900 parts by weight per totally 100 parts by weight of the polycarbonate resin having the recurring structural unit represented by the formula (I) and the charge transporting substances. When it is less than 300 parts by weight, viscosity of the composition is too high and it tends to become difficult to form a uniform coat. When it is more than 900 parts by weight, viscosity of the composition is too low and thickness of the coat tends to become too thin.

The polycarbonate resin having the recurring structural unit represented by the formula (I) is used preferably in an amount of 50–450 parts by weight per 100 parts by weight of the charge transporting substance not so as to deteriorate electrophotographic characteristics and from the point of properties of the coat.

Furthermore, the composition for charge transport layer of the present invention can optionally contain additives such as known plasticizers, flowability imparting agents and pinhole inhibitors. These additives are used preferably in an amount of at most 5 parts by weight per 100 parts by weight of the charge transporting substance, respectively.

The present invention further relates to a composition for charge transport layers which comprises:

(a) a polycarbonate resin having the recurring structural unit represented by the formula (I), (b) a styryl compound represented by the formula (II), (c) a hydrazone compound represented by the formula (III) and (d) a solvent.

As the polycarbonate resin having the recurring unit represented by the formula (I), there may be used those which are referred to hereabove.

The polycarbonate resin having the recurring structural unit represented by the formula (I) can be prepared by reacting a bisphenol A derivative represented by the following formula (Ia) or an alkali metal salt thereof:

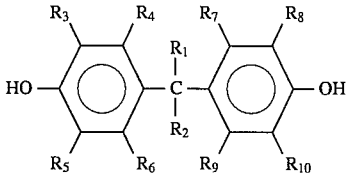

(Ia)

wherein $R_1$, $R_2$, $R_3$, $R_4$, $R_5$, $R_6$, $R_7$, $R_8$, $R_9$ and $R_{10}$ are as defined in the formula (I), and a biphenol derivative represented by the following formula (Ib) or an alkali metal salt thereof:

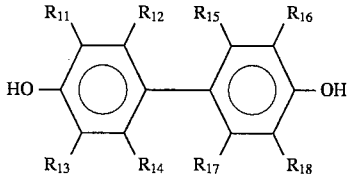

(Ib)

wherein $R_{11}$, $R_{12}$, $R_{13}$, $R_{14}$, $R_{15}$, $R_{16}$, $R_{17}$ and $R_{18}$ are as defined in the formula (I), with phosgene

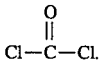

Among the definitions of the symbols in the formula (II), the aryl group includes, for example, phenyl, biphenyl, terphenyl and naphthyl and the substituent which attaches to the aryl group includes, for example, dialkylamino, diaralkylamino, alkyl, alkoxy, nitro, cyano, hydroxy and halogen atom.

As preferred examples of the styryl compounds represented by the formula (II), there may be used those which are referred to hereabove, but they are not limited thereto.

Among the definitions of the symbols in the formula (III), the alkyl group includes, for example, methyl, ethyl, n-propyl, isopropyl, n-butyl, tert-butyl, n-pentyl and n-hexyl and aralkyl group includes, for example, benzyl, phenylethyl and naphthylmethyl.

As preferred examples of the hydrazone compounds represented by the formula (III), there may be used those which have the following structural formulas, but they are not limited thereto.

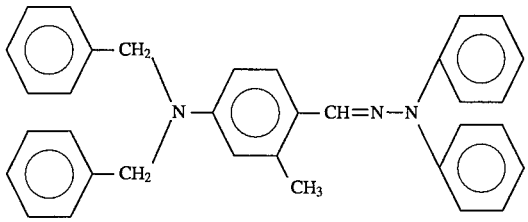

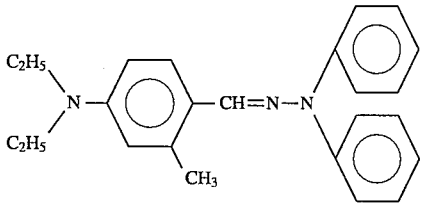

-continued

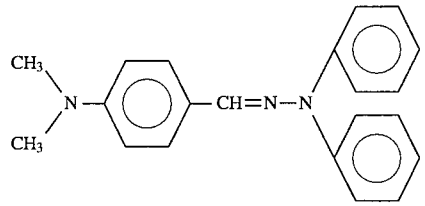

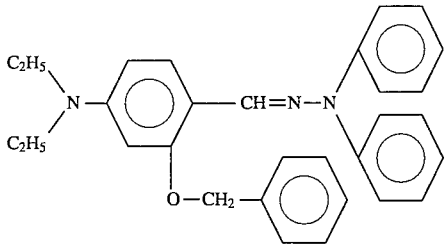

The solvents used in the present invention may be known ones. Use of the solvents of too high or too low boiling point causes unevenness in the thickness of the coat when dip coating is employed, resulting in fluctuation in characteristics of the resulting electrophotographic members depending on the positions. Therefore, solvents which have a boiling point of 35°–160° C. are preferred, those which have a boiling point of 40°–140° C. are more preferred and those which have a boiling point of 40°–120° C. are most preferred.

Furthermore, in order to make the coat uniform in both the form and the composition, it is necessary that the solvents can dissolve the polycarbonate resins having the recurring structural unit represented by the formula (I) and the charge transporting substances such as the styryl compounds represented by the formula (II) and the hydrazone compounds represented by the formula (III). Non-halogen solvents are preferred from the viewpoint of environmental health. Examples of these solvents are tetrahydrofuran, dioxane, methyl ethyl ketone, methyl n-propyl ketone, methyl isobutyl ketone, benzene, toluene, xylene, cyclohexanone, Cellosolve, ethyl Cellosolve, butyl Cellosolve, etc. These solvents may be used each alone or in combination of two or more. Amount of the solvents is preferably 300–900 parts by weight per totally 100 parts by weight of the charge transporting substances represented by the formulas (II) and (III) and the polycarbonate resin having the recurring structural unit represented by the formula (I). When it is less than 300 parts by weight, viscosity of the composition is too high and it tends to become difficult to form a uniform coat. When it is more than 900 parts by weight, viscosity of the composition is too low and thickness of the coat tends to become too thin.

The polycarbonate resin having the recurring structural unit represented by the formula (I) is used preferably in an amount of 50–450 parts by weight per 100 parts by weight of the charge transporting substances (total amount of the styryl compound represented by the formula (II) and the hydrazone compound represented by the formula (III)) not so as to deteriorate electrophotographic characteristics and in view of the properties of the coat. With reference to the proportion of the styryl compound represented by the formula (II) and the hydrazone compound represented by the formula (III), it is preferred to use the hydrazone compound in an amount of 10–250 parts by weight per 100 parts by weight of the styryl compound not so as to deteriorate the electrophotographic characteristics. When amount of the hydrazone compound is less than 10 parts by weight, the resolution decreases and when it is more than 250 parts by weight, the drift mobility decreases to cause an increase in residual potential.

Furthermore, the composition for charge transport layer of the present invention can optionally contain additives such as known plasticizers, flowability imparting agents and pinhole inhibitors. These additives are used preferably in an amount of at most 5 parts by weight per 100 parts by weight of the charge transporting substance, respectively.

The present invention further relates to an electrophotographic member having a charge transport layer formed using the above-mentioned composition for charge transport layer of the present invention. Production of the electrophotographic member will be explained in detail below.

The electrophotographic member is obtained by forming a charge generation layer and a charge transport layer on an electroconductive substrate on which, if necessary, an undercoat layer has been provided. The electroconductive substrate includes, for example, metals such as aluminum, iron, copper and nickel, paper or plastic films, sheets and seamless belts subjected to electroconducting treatment, plastic films, sheets and seamless belts clad with a metal foil such as aluminum foil and electroconductors such as film-like sheets and seamless belts of metal sheets and metal drums.

A customarily used undercoat layer can be provided on the electroconductive substrate. As the undercoat layer, there may be used, for example, fine particles such as titanium oxide, aluminum oxide, zirconia, titanic acid, zirconic acid, lead lanthanum, titanium black, silica, lead titanate and barium titanate, polyamide resins, phenol resins, casein, melamine resins, benzoguanamine resins, polyurethane resins, epoxy resins, celluloses and polyvinyl butyral resins. These fine particles and resins can be used each alone or in admixture of two or more. Use of the fine particles and the resins in combination is especially desirable since the fine particles are adsorbed on the resins and a smooth film can be obtained.

The undercoat layer can be formed by coating a solution or a dispersion prepared by dispersing or dissolving the above fine particles and/or resin in a solvent on the electroconductive substrate by dip coating, spray coating, roll coating, applicator coating, wire bar coating and the like and drying the coat.

As the solvent, mention may be made of, for example, acetone, methyl ethyl ketone, methyl isobutyl ketone, tetrahydrofuran, toluene, ethyl acetate, xylene, Cellosolve, methanol, ethyl Cellosolve, butyl Cellosolve, isopropyl alcohol, isobutyl alcohol, n-butyl alcohol, cyclohexanone, etc. Thickness of the undercoat layer is usually 0.01–20.0 μm, preferably 0.1–3.0 μm. When the thickness is less than 0.01 μm, it is difficult to form the undercoat layer uniformly and when it is more than 20.0 μm, the electrophotographic characteristics tend to deteriorate.

After forming the undercoat layer as mentioned above, a charge generation layer and a charge transport layer can be formed on the undercoat layer in succession.

As photoconductive substances used in the charge generation layer, mention may be made of organic pigments which generate a charge upon irradiation with light, such as azoxybenzene, disazo, trisazo, benzimidazole, polycyclic quinoline, indigoid, quinacridone, phthalocyanine, naphthalocyanine, pyrrolopyrrole, perylene and methine pigments.

When the charge generation layer is formed with only the photoconductive substance, vacuum deposition method is employed. When it is formed with the photoconductive substance and other components, the photoconductive substance, a binder, a plasticizer and optional additives such as a curing catalyst, a flowability imparting agent and a pinhole inhibitor are uniformly dissolved or dispersed in a solvent such as acetone, methyl ethyl ketone, methyl isobutyl ketone, tetrahydrofuran, ethyl acetate, Cellosolve, ethyl Cellosolve, butyl Cellosolve, cyclohexanone, methanol, isopropyl alcohol, isobutyl alcohol or n-butyl alcohol or a mixed solvent thereof to prepare a coating fluid for charge generation layer. The resulting coating fluid is coated on the undercoat layer by dip coating, spray coating, roll coating, applicator coating, wire bar coating or the like and is dried to form the charge generation layer.

As the binder, mention may be made of, for example, silicone resins, polyamide resins, polyurethane resins, polyester resins, epoxy resins, polyketone resins, polycarbonate resins, polystyrene resins, polymethacrylate resins, polyacrylamide resins, polybutadiene resins, polyisoprene resins, melamine resins, benzoguanamine resins, polychloroprene resins, polyacrylonitrile resins, ethylcellulose resins, nitrocellulose resins, urea resins, phenol resins, phenoxy resins, polyvinyl butyral resins, formal resins, vinyl acetate resins, vinyl acetate/vinyl chloride copolymers and polyester carbonate resins. Besides, thermo- and/or photo-setting resins may also be used. They have no limitation as far as they are resins which have electrically insulating properties and can form a film in normal state.

When the charge generation layer is formed using the photoconductive substance and other components as mentioned above, the binder resin is used preferably in an amount of 5–200 parts by weight, more preferably in an amount of 10–100 parts by weight per 100 parts by weight of the photoconductive substance. When amount of the binder resin is less than 5 parts by weight, the coat of the charge generation layer is apt to be ununiform and the image quality tends to deteriorate. When it is more than 200 parts by weight, sensitivity tends to decrease and residual potential tends to increase.

Examples of the plasticizer are halogenated paraffins, dimethylnaphthalene and dibutyl phthalate. Examples of the curing catalyst are of sulfonic acid type such as methanesulfonic acid, dodecylbenzenesulfonic acid and dinonylnaphthalenedisulfonic acid. Examples of the flowability imparting agent are Modaflow (manufactured by Monsanto Chemical Co.) and Acronal 4F (manufactured by BASF Corp.). Examples of the pinhole inhibitor are benzoin and dimethyl phthalate. Each of them is used preferably in an amount of 5 parts by weight or less based on the photoconductive substance.

Thickness of the charge generation layer is usually 0.01–2.0 μm, preferably 0.1–0.8 μm. When the thickness is less than 0.01 μm, it is difficult to uniformly form the charge generation layer and when it is more than 2.0 μm, electrophotographic characteristics are apt to deteriorate.

On the thus formed charge generation layer is coated the composition for charge transport layer prepared as mentioned above by dip coating, spray coating, roll coating, applicator coating, wire bar coating or the like and is dried to form the charge transport layer.

Thickness of the charge transport layer is usually 5–50 μm, preferably 8–35 μm. When the thickness is less than 5 μm, the potential is apt to decrease at the initial stage and when it is more than 50 μm, electrophotographic characteristics tend to deteriorate.

In the electrophotographic members of the present invention, a protective layer may further be provided on the charge transport layer from the viewpoint of wear resistance. Thickness of the protective layer is 0.01–10 μm, preferably 0.1–3 μm. When the thickness is less than 0.01 μm, the protective layer does not exert its effect and is inferior in endurance and when it is more than 10 μm, sensitivity tends to decrease and residual potential tends to increase.

Printing with the electrophotographic member of the present invention can be performed by carrying out charging and exposing, subsequent developing, transferring the images onto a plain paper and fixing the transferred images as in the conventional methods.

The present invention will be explained by the following Examples, but not limited thereto.

Materials used in the Examples are enumerated below. The symbol in the parentheses is the abbreviation of the name of the materials.

(a) Photoconductive substance which generates charge: τ-type metal-free phthalocyanine (τ-$H_2Pc$) (manufactured by Toyo Ink Mfg. Co., Ltd.)

(b) Charge transporting substances:

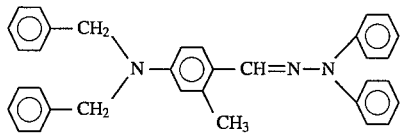

(HD-1)

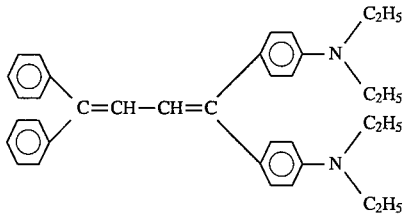

(PBD)

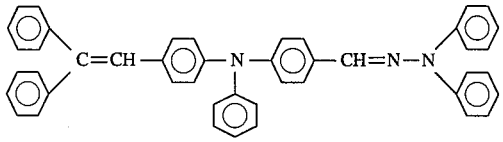

(HD)

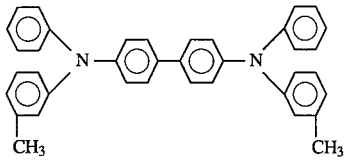

(TPD)

(A) Materials for undercoat layer:

MX 1970 (MX 1970)

Solid content 100% by weight (manufactured by Japan Rilsan Co.)

Melan 2000 (ML 2000) (Butylated melamine resin having the number of combined formaldehyde of 4.0 and the number of methylol group of 1.0), solid content: 50% by weight (manufactured by Hitachi Cgemical Co., Ltd.)

(B) Material for charge generation layer:

Brominated phenoxy resin

YPB-43 (YPB-43), solid content: 40% by weight (manufactured by Toto Kasei Co.)

(C) Materials for charge transport layer:

Polycarbonate resin having the following structure:

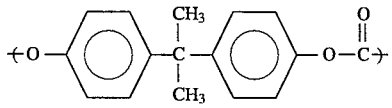

Lexan 141-111 (L 141), solid content: 100% by weight (manufactured by General Electric Co.)

Polycarbonate resin having the following structure:

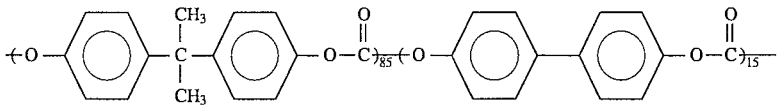

BP-Pc (BP-Pc), solid content: 100% by weight

Polycarbonate resin having the following structure:

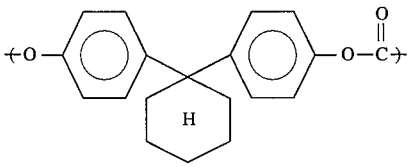

TS-2050 (TS-2050), solid content: 100% by weight (manufactured by Teijin Kasei Co.)

COMPARATIVE EXAMPLE 1

70 g of MX 1970, 140 g of ML 2000 and 4.2 g of trimellitic acid were completely dissolved in 3600 g of methyl ethyl ketone. The resulting solution was coated on an aluminum drum (outer diameter: 100 mm, length: 336 mm, thickness: 2.5 mm) by dip coating method and dried at 120° C. for 30 minutes to form an undercoat layer of 0.3 μm thick.

Then, 100 g of τ-$H_2$Pc, 200 g of YPB-43 and 3700 g of tetrahydrofuran were dispersed for 80 hours by an ultrasonic dispersing machine. The thus obtained coating fluid for charge generation layer was coated on the above undercoat layer by dip coating method and dried at 140° C. for 30 minutes to form a charge generation layer of 0.3 μm thick.

Next, 140 g of PBD and 260 g of L 141 were dissolved in 2400 g of tetrahydrofuran. This solution was coated on the charge generation layer having the undercoat layer by dip coating method and dried at 100° C. for 30 minutes to form a charge transport layer of 17 μm thick. Thus, an electrophotographic member was obtained.

COMPARATIVE EXAMPLE 2

An undercoat layer of 0.3 μm thick was formed on an aluminum drum (outer diameter: 120 mm, length: 486 mm, thickness: 4 mm) using the same materials and procedure as in Comparative Example 1. Then, a charge generation layer of 0.3 μm thick was formed on the undercoat layer using the same materials and procedure as in Comparative Example 1.

Then, 140 g of HD and 260 g of L 141 were dissolved in 2400 g of tetrahydrofuran. This solution was coated on the charge generation layer having the undercoat layer by dip coating method and dried at 100° C. for 30 minutes to form a charge transport layer of 16 μm thick. Thus, an electrophotographic member was obtained.

COMPARATIVE EXAMPLE 3

An undercoat layer of 0.3 μm thick was formed on an aluminum drum (outer diameter: 120 mm, length: 486 mm, thickness: 4 mm) using the same materials and procedure as in Comparative Example 1. Then, a charge generation layer of 0.3 μm thick was formed on the undercoat layer using the same materials and procedure as in Comparative Example 1.

Then, 140 g of TPD and 260 g of L141 were dissolved in 2400 g of tetrahydrofuran. This solution was coated on the charge generation layer having the undercoat layer by dip coating method and dried at 110° C. for 30 minutes to form a charge transport layer of 17 μm thick. Thus, an electrophotographic member was obtained.

EXAMPLE 1

An undercoat layer of 0.3 μm thick was formed on an aluminum drum (outer diameter: 120 mm, length: 486 mm, thickness: 4 mm) using the same materials and procedure as in Comparative Example 1. Then, a charge generation layer of 0.3 μm thick was formed on the undercoat layer using the same materials and procedure as in Comparative Example 1.

Then, 140 g of PBD and 260 g of BP-Pc were dissolved in 2400 g of tetrahydrofuran. This solution was coated on the charge generation layer having the undercoat layer by dip coating method and dried at 100° C. for 30 minutes to form a charge transport layer of 18 μm thick. Thus, an electrophotographic member was obtained.

EXAMPLE 2

An undercoat layer of 0.3 μm thick was formed on an aluminum drum (outer diameter: 120 mm, length: 486 mm, thickness: 4 mm) using the same materials and procedure as in Comparative Example 1. Then, a charge generation layer of 0.3 μm thick was formed on the undercoat layer using the same materials and procedure as in Comparative Example 1.

Then, 140 g of HD and 260 g of BP-Pc were dissolved in 2400 g of tetrahydrofuran. This solution was coated on the charge generation layer having the undercoat layer by dip coating method and dried at 100° C. for 30 minutes to form a charge transport layer of 16 μm thick. Thus, an electrophotographic member was obtained.

EXAMPLE 3

An undercoat layer of 0.3 μm thick was formed on an aluminum drum (outer diameter: 120 mm, length: 486 mm, thickness: 4 mm) using the same materials and procedure as in Comparative Example 1. Then, a charge generation layer of 0.3 μm thick was formed on the undercoat layer using the same materials and procedure as in Comparative Example 1.

Then, 140 g of TPD and 260 g of BP-Pc were dissolved in 2400 g of tetrahydrofuran. This solution was coated on the charge generation layer having the undercoat layer by dip coating method and dried at 110° C. for 30 minutes to form a charge transport layer of 18 μm thick. Thus, an electrophotographic member was obtained.

Photoresponsiveness of the electrophotographic members obtained in the above Comparative Examples and Examples, quality of images formed thereon and mixing state in solid phase of the charge transporting substance and the polycarbonate resin in the charge transport layer were evaluated by the following methods.

Photoresponsiveness: An electrophotographic member was subjected to corona charging to obtain a surface potential of −700 V and the photoresponsiveness was evaluated by measuring the time required for $V_0$ reaching −350 V when it was irradiated with a light of 780 nm in wavelength for 20 ms using a light decay measuring device (Cynthia 30 manufactured by Midoriya Denki K. K.).

Quality of image: This was evaluated in terms of fogging, black point, white stains and black density using an image evaluating device (negative charge, reversal development system). The surface potential was set at −700 V and the bias potential was set at −600 V. The black image density was evaluated by Macbeth reflection densitometer (manufactured by a division of Kollmergan Corporation).

The mixing state of the charge transporting substance and the polycarbonate resin in the charge transport layer was evaluated by differential scanning calorimetry (DSC). The device used was differential scanning calorimeter DSC-200 manufactured by Seiko Denshi Kogyo K. K.). Measuring conditions were as follows: amount of sample: 100 mg, heating rate: 10° C./min and measuring temperature range: −150° C. to 250° C. As the sample, only a charge transport layer was used which was directly formed on an aluminum sheet by the method for formation of the charge transport layer employed in the above Examples and Comparative Examples.

The peak (melting point) originating from the charge transporting substance in the charge transport layer which is a mixed solid phase is indicated by Tm. The change (glass transition temperature) caused by plasticization of the polycarbonate resin and the charge transport layer which is a mixed solid phase is indicated by Tg.

Table 1 shows photoresponsiveness, Tg and Tm in the mixed state of the charge transport layer, fogging, black point, white stains and image density.

Figure 2:
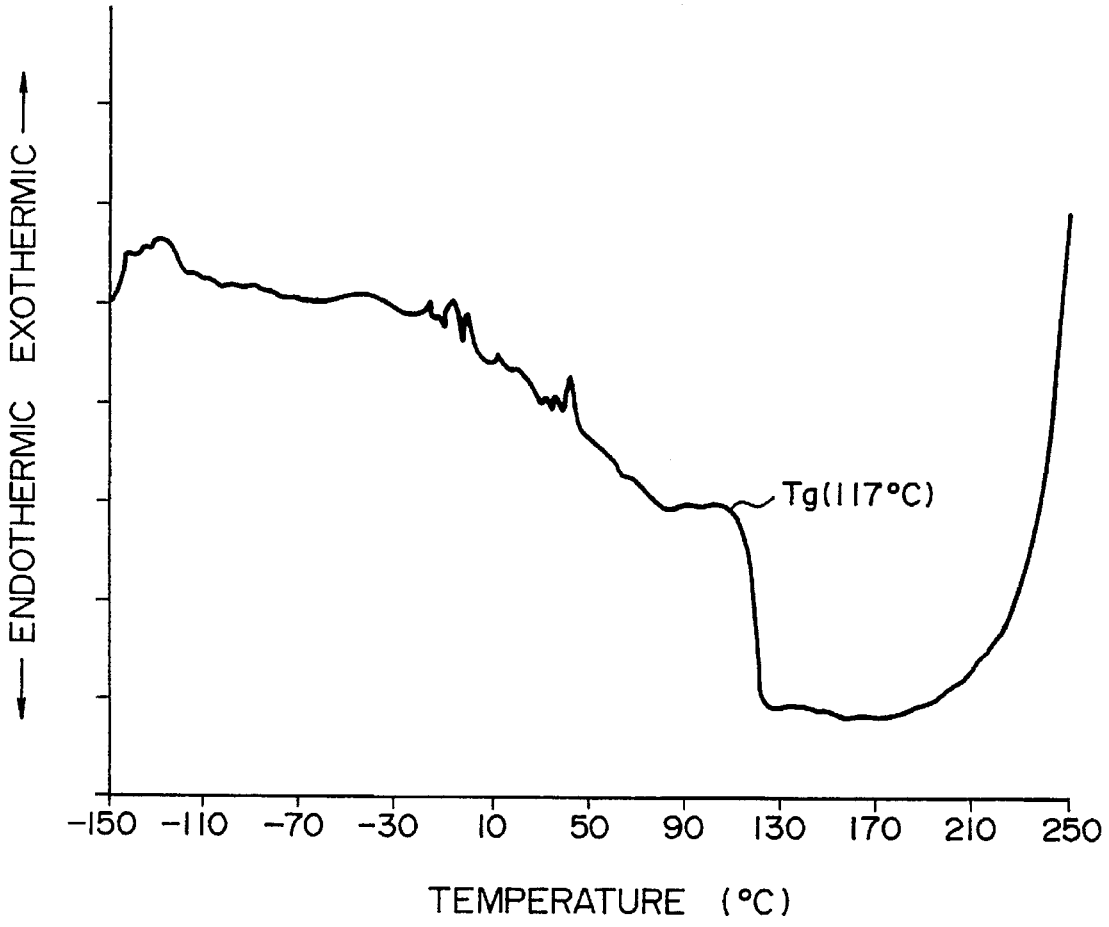
FIG. 2 is a DSC chart of the charge transport layer obtained in Example 2.
Figure 3:
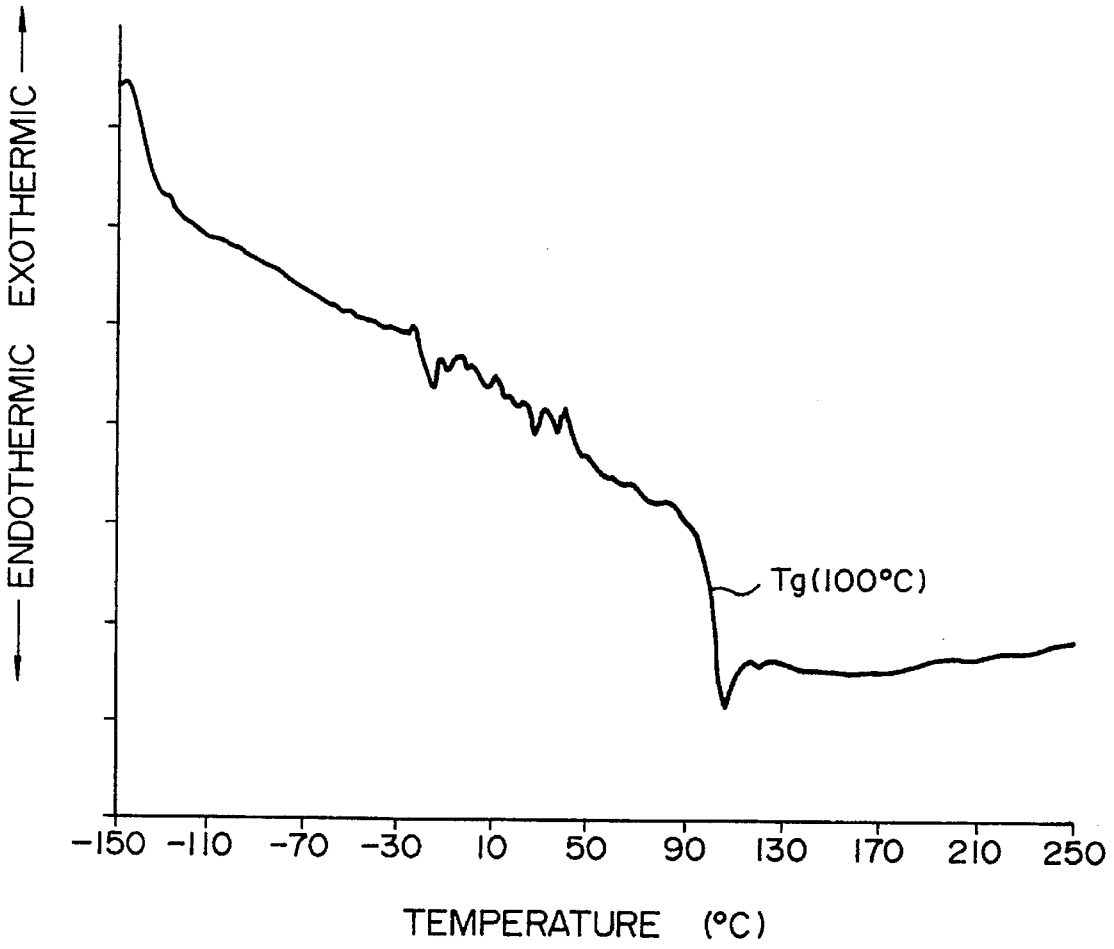
FIG. 3 is a DSC chart of the charge transport layer obtained in Example 3.

DSC charts of the charge transport layer in Examples 1–3 are shown in FIG. 1, FIG. 2 and FIG. 3, respectively.

TABLE 1

| Properties | Comparative Example 1 | Comparative Example 2 | Comparative Example 3 | Example 1 | Example 2 | Example 3 |
|---|---|---|---|---|---|---|
| Photoresponsiveness (25° C., ms) | 18 | 7 | 8 | 12 | 6 | 6 |
| Mixing state of charge transport layer | | | | | | |
| Tg (°C.) | 100 | 108, 145 | 102 | 104 | 117 | 100 |
| Tm (°C.) | 168 | 98 | 167 | Unobservable | Unobservable | Unobservable |
| Image quality Reversal development | | | | | | |
| Fogging | Occurred much | Occurred much | Occurred much | Little | Little | Little |
| Black point | Many | Many | Many | Few | Few | Few |
| White stains | Many | Many | Many | Few | Few | Few |
| Image density | 1.2 | 1.4 | 1.4 | 1.3 | 1.4 | 1.4 |

When in the charge transport layer, bisphenol A type polycarbonate resin (Tg was 148° C. from the result of measurement of DSC of the resin alone) was used and PBD (Tm was 169° C. from the result of measurement of DSC of PBD alone) was contained in an amount of 35% by weight (Comparative Example 1), photoresponsiveness was 18 ms. As a result of measurement of DSC of the charge transport layer, Tg and Tm were observed at 100° C. and 168° C. Thus, it was found that phase separation occurred between the bisphenol A type polycarbonate resin and PBD. Furthermore, the image formed in Comparative Example 1 had much fog, many black points and white stains and had an image density of 1.2.

When in the charge transport layer, bisphenol A type polycarbonate resin (Tg was 148° C. from the result of measurement of DSC of the resin alone) was used and HD (Tm was 96° C. from the result of measurement of DSC of HD alone) or TPD (Tm was 168.3° C. from the result of measurement of DSC of TPD alone) was contained in an amount of 35% by weight (Comparative Example 2 and Comparative Example 3), photoresponsiveness was 7 ms and 8 ms. Tg was observed at 108° C. and 145° C. (Comparative Example 2) and 102° C. (Comparative Example 3) and Tm was observed at 98° C. (Comparative Example 2) and 167° C. (Comparative Example 3). Thus, it was found that phase separation occurred between the bisphenol A type polycarbonate resin and HD and TPD. Furthermore, the images formed in Comparative Examples 2 and 3 had much fog, many black points and white stains and had image density of 1.4 in both Comparative Examples 2 and 3.

On the other hand, results on the electrophotographic members of the present invention are as follows. When in the charge transport layer, BP-Pc polycarbonate resin (Tg was 156° C. from the result of measurement of DSC of the resin alone) was used and PBD, HD or TPD was contained in an amount of 35% by weight (Example 1, Example 2 and Example 3), photoresponsiveness was 12 ms, 6 ms and 6 ms. Tg was observed at 104° C. (Example 1), 117° C. (Example 2) and 100° C. (Example 3) and no Tm was observed. It was found therefrom that BP-Pc polycarbonate resin and PBD, HD and TPD were dissolved with each other. The resulting images had no fog, black points and white stains and had superior image quality. Image density was 1.3, 1.4 and 1.4 (Examples 1–3).

COMPARATIVE EXAMPLE 4

In the same manner as in Comparative Example 1, an undercoat layer of 0.3 μm thick and a charge generation layer of 0.3 μm thick were formed in succession on an aluminum drum (outer diameter: 100 mm, length: 336 mm, thickness: 2.5 mm). Then, 126 g of PBD, 54 g of HD-1 and 220 g of TS-2050 were dissolved in 2400 g of tetrahydrofuran. This solution was coated on the charge generation layer having the undercoat layer by dip coating method and dried at 100° C. for 30 minutes to form a charge transport layer of 16 μm thick. Thus, an electrophotographic member was obtained.

COMPARATIVE EXAMPLE 5

In the same manner as in Comparative Example 1, an undercoat layer of 0.3 μm thick and a charge generation layer of 0.3 μm thick were formed in succession on an aluminum drum (outer diameter: 100 mm, length: 336 mm, thickness: 2.5 mm). Then, 90 g of PBD, 90 g of HD-1 and 220 g of TS-2050 were dissolved in 2400 g of tetrahydrofuran. This solution was coated on the charge generation layer having the undercoat layer by dip coating method and dried at 110° C. for 30 minutes to form a charge transport layer of 17 μm thick. Thus, an electrophotographic member was obtained.

COMPARATIVE EXAMPLE 6

In the same manner as in Comparative Example 1, an undercoat layer of 0.3 μm thick and a charge generation layer of 0.3 μm thick were formed in succession on an aluminum drum (outer diameter: 100 mm, length: 336 mm, thickness: 2.5 mm). Then, 72 g of PBD, 108 g of HD-1 and 220 g of TS-2050 were dissolved in 2400 g of tetrahydrofuran. This solution was coated on the charge generation layer having the undercoat layer by dip coating method and dried at 110° C. for 30 minutes to form a charge transport layer of 17 μm thick. Thus, an electrophotographic member was obtained.

EXAMPLE 4

Using the same materials and the procedure as in Comparative Example 1, an undercoat layer of 0.3 μm thick and a charge generation layer of 0.3 μm thick were formed in succession on an aluminum drum (outer diameter: 100 mm, length: 336 mm, thickness: 2.5 mm). Then, 126 of PBD, 54 g of HD-1 and 220 g of BP-Pc were dissolved in 2400 g of tetrahydrofuran. This solution was coated on the charge generation layer having the undercoat layer by dip coating method and dried at 100° C. for 30 minutes to form a charge transport layer of 18 μm thick. Thus, an electrophotographic member was obtained.

EXAMPLE 5

Using the same materials and the procedure as in Comparative Example 1, an undercoat layer of 0.3 μm thick and a charge generation layer of 0.3 μm thick were formed in succession on an aluminum drum (outer diameter: 100 mm, length: 336 mm, thickness: 2.5 mm). Then, 90 g of PBD, 90 g of HD-1 and 220 g of BP-Pc were dissolved in 2400 g of tetrahydrofuran. This solution was coated on the charge generation layer having the undercoat layer by dip coating method and dried at 100° C. for 30 minutes to form a charge transport layer of 16 μm thick. Thus, an electrophotographic member was obtained.

EXAMPLE 6

Using the same materials and the procedure as in Comparative Example 1, an undercoat layer of 0.3 μm thick and a charge generation layer of 0.3 μm thick were formed in succession on an aluminum drum (outer diameter: 100 mm, length: 336 mm, thickness: 2.5 mm). Then, 72 g of PBD, 108 g of HD-1 and 220 g of BP-Pc were dissolved in 2400 g of tetrahydrofuran. This solution was coated on the charge generation layer having the undercoat layer by dip coating method and dried at 110° C. for 30 minutes to form a charge transport layer of 18 μm thick. Thus, an electrophotographic member was obtained.

EXAMPLE 7

Using the same materials and the procedure as in Comparative Example 1, an undercoat layer of 0.3 μm thick and a charge generation layer of 0.3 μm thick were formed in succession on an aluminum drum (outer diameter: 100 mm, length: 336 mm, thickness: 2.5 mm). Then, 98 g of PBD, 42 g of HD-1 and 260 g of BP-Pc were dissolved in 2400 g of tetrahydrofuran. This solution was coated on the charge generation layer having the undercoat layer by dip coating method and dried at 100° C. for 30 minutes to form a charge transport layer of 18 μm thick. Thus, an electrophotographic member was obtained.

EXAMPLE 8

Using the same materials and the procedure as in Comparative Example 1, an undercoat layer of 0.3 μm thick and a charge generation layer of 0.3 μm thick were formed in succession on an aluminum drum (outer diameter: 100 mm, length: 336 mm, thickness: 2.5 mm). Then, 63 g of PBD, 77 g of HD-1 and 260 g of BP-Pc were dissolved in 2400 g of tetrahydrofuran. This solution was coated on the charge generation layer having the undercoat layer by dip coating method and dried at 100° C. for 30 minutes to form a charge transport layer of 16 μm thick. Thus, an electrophotographic member was obtained.

Surface appearance and drift mobility of the charge transport layer of the electrophotographic members obtained in the above Comparative Examples and Examples and resolution, image quality and electrophotographic properties of the electrophotographic members were evaluated in the following manners. The results of evaluation of surface appearance, drift mobility and resolution are shown in Table 2 and the results of evaluation of image quality (image density) and electrophotographic properties are shown in Table 3.

The surface appearance of the charge transport layer was visually evaluated. The drift mobility was obtained by X-TOF (Xerographic Time of Flight) method using a light decay measuring device (Cynthia 30 manufactured by Midoriya Denki K. K.) under a charging condition of 32 (MV/m) in field strength and using an LED pulsed beam of 660 nm in wavelength.

The resolution was evaluated as follows: An electrophotographic member comprising an aluminum sheet (10 cm×10 cm×0.1 mm thick) and, provided thereon, a blocking layer/a charge generation layer/a charge transport layer was prepared in the same manner as in the above Examples and Comparative Examples and evaluation was conducted. With reference to the evaluation of the initial resolution, the electrophotographic member was charged by corona discharge so that the surface potential reached −800 V, then exposed at 100 lux through Chart No. 1-T of Electrophotographic Society as an original and then developed with a positively charged toner, and the resulting toner image was transferred onto a white paper and fixed to obtain a test image and the resolution was expressed as the number of lines per 1 mm which can be clearly defined by separate lines in the image. Thereafter, the electrophotographic member was subjected to 3000 cycles (6 hours), one cycle of which consisted of corona charging—exposure (660 nm, 5000 lux)—erasing (fluorescent lamp, Filter BPB50). Then, the electrophotographic member after subjected to the accelerated deterioration for 6 hours was evaluated on resolution under the same conditions as in evaluation of the initial resolution referred to hereabove.

The image quality and the electrophotographic properties were evaluated in terms of black image density, surface potential ($V_0$) and residual potential (Vr) at the initial printing and after printing of 200,000 copies using a semiconductor laser beam printer SL-2000 (manufactured by Hitachi, Ltd.). The image density was evaluated Macbeth reflection densitometer (manufactured by A division of Kollmergen Corporation). Corona charging current of the printer was adjusted so that only the initial surface potential of all the electrophotographic members was −630 V.

TABLE 2

| Comparative Example and Example | Surface appearance of charge transport layer | Drift mobility ($cm^2$/V. sec) | Initial resolution (line/mm) | Resolution after accelerated deterioration for 6 hours (line/mm) |
|---|---|---|---|---|
| Comparative Example 1 | Uniform | Unmeasurable | Unmeasurable | Unmeasurable |
| Comparative Example 4 | Good | $2.1 \times 10^{-6}$ | 16.0 | 8.0 |
| Comparative Example 5 | Good | $6.8 \times 10^{-7}$ | 16.0 | 10.0 |
| Comparative Example 6 | Good | $4.6 \times 10^{-7}$ | 16.0 | 12.5 |
| Example 4 | Good | $3.4 \times 10^{-6}$ | 16.0 | 10.0 |
| Example 5 | Good | $1.9 \times 10^{-6}$ | 16.0 | 12.5 |
| Example 6 | Good | $1.2 \times 10^{-6}$ | 16.0 | 12.5 |
| Example 7 | Good | $2.0 \times 10^{-6}$ | 16.0 | 12.5 |
| Example 8 | Good | $1.0 \times 10^{-6}$ | 16.0 | 12.5 |

TABLE 3

| Comparative Example and Example | Image density | | Electrophotographic properties | |
|---|---|---|---|---|
| | Initial | After printing of 200,000 copies | Initial (Vo/Vr) | After printing of 200,000 copies (Vo/Vr) |
| Comparative Example 1 | Unmeasurable | Unmeasurable | Unmeasurable | Unmeasurable |
| Comparative Example 4 | 1.3 | 1.1 | 630/70 | 550/140 |
| Comparative Example 5 | 1.2 | 1.0 | 630/105 | 595/150 |
| Comparative Example 6 | 1.1 | 0.9 | 630/110 | 620/180 |
| Example 4 | 1.4 | 1.3 | 630/55 | 600/68 |
| Example 5 | 1.3 | 1.3 | 630/75 | 610/73 |
| Example 6 | 1.3 | 1.2 | 630/87 | 585/108 |
| Example 7 | 1.3 | 1.2 | 630/70 | 590/105 |
| Example 8 | 1.3 | 1.2 | 630/90 | 585/110 |

As can be seen from Tables 2 and 3, when a bisphenol A type polycarbonate resin was used in the charge transport layer (Comparative Example 1), the resin did not dissolve in the solvent tetrahydrofuran and no uniform coat was able to be formed. When bisphenol Z type polycarbonate resin was used in the charge transport layer and besides PBD was contained in an amount of 31.5% by weight and HD-1 was contained in an amount of 13.5% by weight (Comparative Example 4), the surface appearance of the charge transport layer was good and the drift mobility was higher than $1\times10^{-6}$ ($cm^2$/v.sec), but resolution after accelerated deterioration test was inferior, namely, 8.0 (lines/mm). The image density obtained after printing of 200,000 copies was 1.1 and Vr after printing of 200,000 copies was high, namely, −140 V.

When bisphenol Z type polycarbonate resin was used in the charge transport layer and besides PBD was contained in an amount of 22.5% by weight and HD-1 was contained in an amount of 22.5% by weight (Comparative Example 5), the surface appearance of the charge transport layer was good, but the drift mobility lowered to $6.8\times10^{-7}$ ($cm^2$/v.sec). Resolution after accelerated deterioration test was inferior, namely, 10.0 (lines/mm). The image density obtained after printing of 200,000 copies was 1.0 and Vr after printing of 200,000 copies was high, namely, −150 V. When bisphenol Z type polycarbonate resin was used in the charge transport layer and besides, PBD was contained in an amount of 18.0% by weight and HD-1 was contained in an amount of 27.0% by weight (Comparative Example 6), the surface appearance of the charge transport layer was good, but the drift mobility lowered to $4.6\times10^{-7}$ ($cm^2$/v.sec). The resolution after accelerated deterioration test was 12.5 (lines/mm). The image density obtained after printing of 200,000 copies was 0.9 and Vr after printing of 200,000 copies was high, namely, −180 V.

On the other hand, surface appearance of the charge transport layer of all the electrophotographic members according to the present invention (Examples 4–8) was good and the drift mobility was higher than $1\times10^{-6}$ ($cm^2$/v.sec) for all the electrophotographic members. The resolution after accelerated deterioration test was 10.0 (lines/mm) in Example 4 and 12.5 (lines/mm) in Examples 5–8. The image density after printing of 200,000 copies was 1.2 or higher for all the electrophotographic members and Vr after printing of 200,000 copies was low, namely, −110 V or lower.

The composition for charge transport layer of the present invention can give homogeneous coating fluids and uniform coat with using non-halogen solvents and the electrophotographic member of the present invention prepared using the above composition is well balanced in all of drift mobility, resolution, image quality and electrophotographic properties. Furthermore, since the image is excellent in endurance, when printing is conducted by a high-speed printer, the electrophotographic member can be very effectively applied to the high-speed printer which needs rapid photoresponsiveness and high image quality.

Moreover, the composition for charge transport layer and the electrophotographic member prepared using the composition according to the present invention are excellent in photoresponsiveness and besides, the charge transporting substance and the polycarbonate resin as a binder are uniformly mixed in the charge transport layer and hence, excellent image quality can be obtained when printing is conducted by a high-speed printer. Accordingly, the electrophotographic member of the present invention can be very advantageously applied to high-speed printers which need rapid responsiveness and high image quality. In addition, no use of chlorine based solvents in the composition for charge transport layer and in preparation of the electrophotographic member using the composition according to the present invention much contributes to environmental protection.

What is claimed is:

1. A composition for a charge transport layer in an electrophotographic member, said composition comprising (a) at least one polycarbonate resin having recurring structural units represented by the formulae:

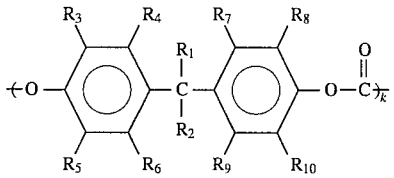

and

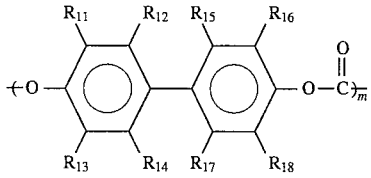

wherein $R_1$ and $R_2$ each represents a hydrogen atom, an alkyl group or an aryl group; $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, $R_{16}$, $R_{17}$ and $R_{18}$ each represents a hydrogen atom, a halogen atom, an alkyl group or an aryl group; and k and m are positive integers and selected so that k/m is in the range of 1 to 10;

(b) a charge transporting substance selected from the group consisting of a styryl compound represented by the formula:

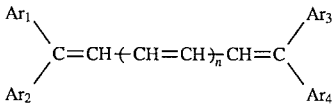

(II)

wherein $Ar_1$, $Ar_2$, $Ar_3$ and $Ar_4$ each represents a substituted or unsubstituted aryl group, and n represents 0 or 1, a hydrazone compound represented by the formula:

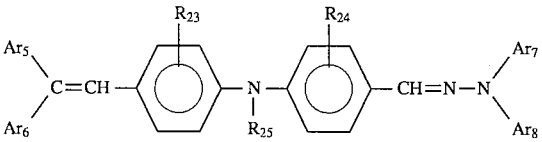

(IV)

wherein $R_{23}$ and $R_{24}$ each represents a hydrogen atom, an alkyl group, an alkoxy group or a halogen atom; $R_{25}$ represents a hydrogen atom, a substituted or unsubstituted alkyl group, a substituted or unsubstituted aralkyl group, a substituted or unsubstituted aryl group, a substituted or unsubstituted condensed polycyclic group or a substituted or unsubstituted heterocyclic group; $Ar_5$ and $Ar_6$ each represents a hydrogen atom, a substituted or unsubstituted alkyl group, a substituted or unsubstituted aryl group, a substituted or unsubstituted condensed polycyclic group or a substituted or unsubstituted heterocyclic group; $Ar_7$ and $Ar_8$ each represents a substituted or unsubstituted alkyl group, a substituted or unsubstituted aryl group, a substituted or unsubstituted condensed polycyclic group or a substituted or unsubstituted heterocyclic group, with a proviso that $Ar_5$ and $Ar_6$ cannot be simultaneously hydrogen atoms and $Ar_5$ and $Ar_6$ and/or $Ar_7$ and $Ar_8$ may form a ring or rings together, and a benzidine compound represented by the formula:

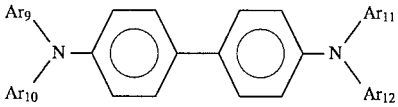

(V)

wherein $Ar_9$, $Ar_{10}$, $Ar_{11}$ and $Ar_{12}$ each represents a substituted or unsubstituted aryl group, substituents in the substituted groups in Formulae (II), (IV) and (V) being selected from the group consisting of halogen atoms, alkyl groups containing 1 to 4 carbon atoms, alkoxy groups containing 1 to 4 carbon atoms, aryl groups selected from the group consisting of phenyl, biphenyl, naphthyl and terphenyl, fluoroalkyl groups containing 1 to 3 carbon atoms and fluoroalkoxy groups containing 1, 2 and 4 carbon atoms; and (c) a solvent.

2. A composition according to claim 1, wherein the solvent is a non-halogen solvent capable of dissolving the single resin or a mixture of the resins.

3. A composition according to claim 1, which contains as the charge transporting substance a styryl compound represented by the formula:

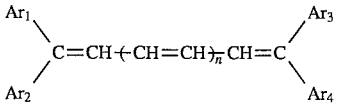

(II)

wherein $Ar_1$, $Ar_2$, $Ar_3$ and $Ar_4$ each represents a substituted or unsubstituted aryl group; and n represents 0 or 1.

4. A composition according to claim 1 which contains as the charge transporting substance a hydrazone compound represented by the formula:

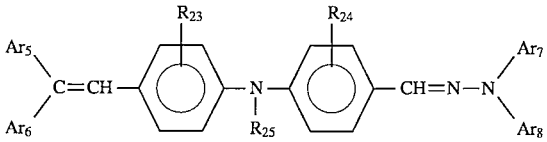

(IV)

wherein $R_{23}$ and $R_{24}$ each represents a hydrogen atom, an alkyl group, an alkoxy group or a halogen atom; $R_{25}$ represents a hydrogen atom, a substituted or unsubstituted alkyl group, a substituted or unsubstituted aralkyl group, a substituted or unsubstituted aryl group, a substituted or unsubstituted condensed polycyclic group or a substituted or unsubstituted heterocyclic group; $Ar_5$ and $Ar_6$ each represents a hydrogen atom, a substituted or unsubstituted alkyl group, a substituted or unsubstituted aryl group, a substituted or unsubstituted condensed polycyclic group or a substituted or unsubstituted heterocyclic group; $Ar_7$ and $Ar_8$ each represents a substituted or unsubstituted alkyl group, a substituted or unsubstituted aryl group, a substituted or unsubstituted condensed polycyclic group or a substituted or unsubstituted heterocyclic group, with a proviso that $Ar_5$ and $Ar_6$ cannot be simultaneously hydrogen atoms and $Ar_5$ and $Ar_6$ and/or $Ar_7$ and $Ar_8$ may form a ring or rings together.

5. A composition according to claim 1, which contains as the charge transporting substance a benzidine compound represented by the formula:

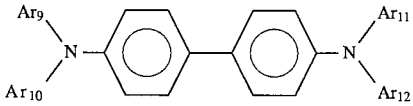

(V)

wherein $Ar_9$, $Ar_{10}$, $Ar_{11}$ and $Ar_{12}$ each represents a substituted or unsubstituted aryl group.

6. An electrophotographic member comprising an electroconductive substrate, a charge generation layer formed thereon, and a charge transport layer formed thereon, said charge transport layer being formed from a composition comprising (a) at least one polycarbonate resin having recurring structural units represented by the formulae:

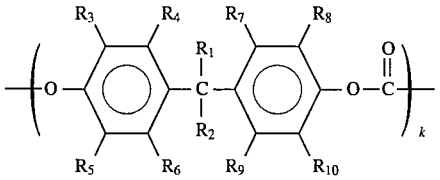

and

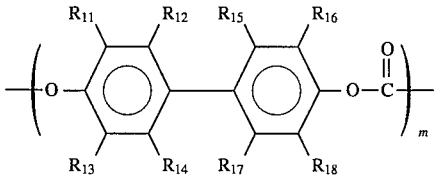

wherein $R_1$ and $R_2$ each represents a hydrogen atom, an alkyl group or an aryl group; $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, $R_{16}$, $R_{17}$ and $R_{18}$ each represents a hydrogen atom, a halogen atom, an alkyl group or an aryl group; and k and m are positive integers and selected so that k/m is in the range of 1 to 10;

(b) a charge transporting substance selected from the group consisting of a styryl compound represented by the formula:

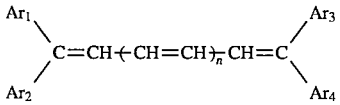

(II)

wherein $Ar_1$, $Ar_2$, $Ar_3$ and $Ar_4$ each represents a substituted or unsubstituted aryl group, and n represents 0 or 1, a hydrazone compound represented by the formula:

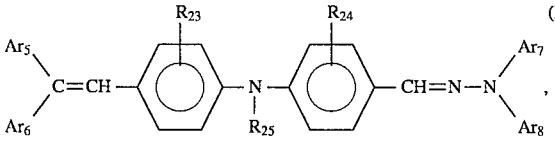

(IV)

wherein $R_{23}$ and $R_{24}$ each represents a hydrogen atom, an alkyl group, an alkoxy group or a halogen atom; $R_{25}$ represents a hydrogen atom, a substituted or unsubstituted alkyl group, a substituted or unsubstituted aralkyl group, a substituted or unsubstituted aryl group, a substituted or unsubstituted condensed polycyclic group or a substituted or unsubstituted heterocyclic group; $Ar_5$ and $Ar_6$ each represents a hydrogen atom, a substituted or unsubstituted alkyl group, a substituted or unsubstituted aryl group, a substituted or unsubstituted condensed polycyclic group or a substituted or unsubstituted heterocyclic group; $Ar_7$ and $Ar_8$ each represents a substituted or unsubstituted alkyl group, a substituted or unsubstituted aryl group, a substituted or unsubstituted condensed polycyclic group or a substituted or unsubstituted heterocyclic group, with a proviso that $Ar_5$ and $Ar_6$ cannot be simultaneously hydrogen atoms and $Ar_5$ and $Ar_6$ and/or $Ar_7$ and $Ar_8$ may form a ring or rings together, and a benzidine compound represented by the formula:

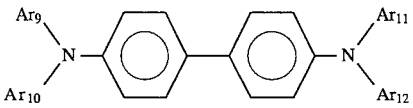

(V)

wherein $Ar_9$, $Ar_{10}$, $Ar_{11}$ and $Ar_{12}$ each represents a substituted or unsubstituted aryl group, substituents in the substituted groups in Formulae (II), (IV) and (V) being selected from the group consisting of halogen atoms, alkyl groups containing 1 to 4 carbon atoms, alkoxy groups containing 1 to 4 carbon atoms, aryl groups selected from the group consisting of phenyl, biphenyl, naphthyl and terphenyl, fluoroalkyl groups containing 1 to 3 carbon atoms and fluoroalkoxy groups containing 1, 2 and 4 carbon atoms; and (c) a solvent; said solvent being removed by drying in the formation of the charge transport layer.

7. An electrophotographic member according to claim 6, which further comprises an undercoat layer between the electroconductive substrate and the charge generation layer.

8. An electrophotographic member according to claim 6, which further comprises a protective layer on the charge transport layer.

* * * * *